US006347669B1

(12) United States Patent
Sundholm

(10) Patent No.: US 6,347,669 B1
(45) **Date of Patent: *Feb. 19, 2002**

(54) SPRINKLER

(76) Inventor: Göran Sundholm, Ilmari Kiannon kuja 3, FIN-04310 Tuusula (FI)

( * ) Notice: Subject to any disclaimer, the term of this patent is extended or adjusted under 35 U.S.C. 154(b) by 0 days.

This patent is subject to a terminal disclaimer.

(21) Appl. No.: 09/535,380

(22) Filed: Mar. 24, 2000

(30) Foreign Application Priority Data

Oct. 8, 1999 (FI) ..... 19992171

(51) Int. Cl.[7] ..... A62C 37/08

(52) U.S. Cl. ..... 169/37; 169/38; 169/42; 169/19; 169/26; 169/56; 169/57; 169/59; 169/60

(58) Field of Search ..... 169/37, 38, 41, 169/42, 19, 26, 56, 57, 59, 60

(56) References Cited

U.S. PATENT DOCUMENTS

| | | | | |
|---|---|---|---|---|
| 399,519 A | * | 3/1889 | Grinnell | 169/37 |
| 1,837,322 A | * | 12/1931 | Hamilton | 169/37 |
| 2,327,528 A | * | 8/1943 | Kendall et al. | 169/37 |
| 2,389,331 A | * | 11/1945 | Tyden | 169/37 |
| 2,389,332 A | | 11/1945 | Tyden | 169/37 |
| 3,727,695 A | | 4/1973 | Danton | 169/37 |
| 4,014,388 A | | 3/1977 | Anderson | 169/37 |
| 4,437,611 A | | 3/1984 | Gilroy | 239/453 |
| 4,880,063 A | | 11/1989 | Leininger et al. | 169/37 |
| 4,976,320 A | | 12/1990 | Polan | 169/39 |
| 5,072,792 A | | 12/1991 | Simons et al. | 169/37 |
| 5,117,916 A | | 6/1992 | Ohta et al. | 169/37 |
| 5,152,344 A | | 10/1992 | Fischer, et al. | 169/37 |
| 5,372,203 A | | 12/1994 | Galaszewski | 169/37 |

FOREIGN PATENT DOCUMENTS

| | | |
|---|---|---|
| EP | 0505672 | 9/1992 |
| JP | 08066492 | 3/1996 |
| WO | 9300962 | 1/1993 |
| WO | 95/31252 | * 11/1995 |
| WO | 9856463 | 12/1998 |

* cited by examiner

*Primary Examiner*—David A. Scherbel
*Assistant Examiner*—Robin O. Evans
(74) *Attorney, Agent, or Firm*—Ladas & Parry

(57) ABSTRACT

The invention relates to a sprinkler comprising a holder body (3), at least one nozzle (2), a heat-activated release means (18) and a cover (13) which in a protective position is arranged in front of said nozzle when the sprinkler is in an inactive mode, the sprinkler comprising means (6, 10) for providing a displacement of the cover from the protective position to a free position in which the cover keeps clear of the nozzle so that it can spray extinguishing medium when the sprinkler is in an active mode, the holder body comprising an inlet (5) for incoming extinguishing medium. In order for the sprinkler to be usable in surroundings where it may be heavily exposed to dirt and impurities and in order for it not to start spraying extinguishing medium when being exposed to heat and with the cover (13) is in a protective position, the cover (13) is arranged, in the protective position, to protect the release means (18) but, when displaced, it is arranged to expose the release means and place the sprinkler in a standby mode in which the release means is intact so as to be able to react to heat and achieve a release of the sprinkler and place it in the active mode, and the means for achieving the displacement of the cover (13) comprises a device (6) which is displaceable with respect to the holder body (3) and which is arranged under fluid pressure to exert a force on a locking means (14, 17) in the cover (13) to make the locking means open and consequently displace the cover to said free position.

16 Claims, 4 Drawing Sheets

SPRINKLER

BACKGROUND OF THE INVENTION

The invention relates to a sprinkler comprising a holder body, at least one nozzle, a heat-activated release means and a cover which in a protective position is arranged in front of said nozzle when the sprinkler is in an inactive mode, the sprinkler comprising means for providing a displacement of the cover from the protective position to a free position in which the cover keeps clear of the nozzle so that it can spray extinguishing medium when the sprinkler is in an active mode, the holder body comprising an inlet for incoming extinguishing medium.

Such sprinklers are known for example from U.S. Pat. Nos. 4,014,388 and 4,880,063. The cover serves to provide an aesthetically appealing sprinkler of a type which in an inactive mode is concealed in a ceiling, for example. In such concealed sprinklers the cover mainly serves to keep a deflect plate in a retracted position for aesthetic reasons.

In these known sprinklers, the cover falls downwards when the material holding the cover in position melts as it is exposed to heat. Once the cover falls, the heat-activated release means of the sprinkler immediately comes into contact with heat, releasing the sprinkler.

Thus these known sprinklers are characterized in that the nozzle or nozzles more or less immediately start to spray extinguishing medium when the cover is displaced.

In certain conditions/surroundings, the sprinklers are exposed to dirt, dust, deposits and other material that can disturb the sprinklers' qualities of reacting to fire or even prevent the supply of extinguishing medium in a fire. Sprinklers are installed in order that they operate, when required, up to several years after installation and, consequently, they are naturally exposed to dirt in certain surroundings. A cover in the form of a plate (cf. U.S. Pat. Nos. 4,014,388 and 4,880,063, for example) installed in front of the nozzles mainly provides mechanical protection against impacts. Some protection against dirt may be provided, but these known sprinklers are mounted in surroundings where dirt presents no problem. In certain surroundings the amount of dirt and impurities is so high that no sprinklers at all have been mounted, the assumption being that they would not operate reliably. This is the case although sprinklers are most desirable in some of these applications. As examples may be mentioned open rail cars transporting expensive equipment that may catch fire, for example vehicles. Other applications include painters' shops and steel plants.

Another major problem in fire extinguishing installations is the synchronization of fire detection with fire extinguishing in such a way that fire extinguishing takes place as rapidly as possible on the site of the fire, i.e. by means of the sprinklers that are located nearest to the fire.

Said problems exist for example in windy surroundings where the heat from the fire is conveyed to sprinklers which are not near the fire. Should these sprinklers have a release means which reacts rapidly to heat, they start to spray extinguishing medium at a location where there is no fire. For this reason in this kind of surroundings sprinklers are used that are released relatively slowly. However, the more slowly the sprinklers are released, the longer the fire has time to advance. Slow initialization of fire extinction is naturally to be avoided, if possible. For the above reasons, known sprinklers are unable to operate as well as is desirable in said surroundings.

Mechanical loads may also make a sprinkler release unnecessarily (especially if the release means of the installation fails). Such mechanical loads may be created by impacts caused by trucks, lorries etc. in industrial halls, garages and on car decks onboard ferries.

In some surroundings there is the risk of a fire starting by an explosion. In such surroundings the ampoule of the sprinkler is likely to be released by the pressure even though no fire or even a risk of fire exists near the sprinkler. Such surroundings include transformers, paint cabinets and paint stocks.

BRIEF DESCRIPTION OF THE INVENTION

The object and idea of the invention is to provide a sprinkler which has a simple structure and an inactive mode in which the sprinkler is not activated or does not get released when directly exposed to heat from flue gases, but which in another functional mode, called standby mode, rapidly becomes released when being exposed to heat from flue gases. Accordingly, the sprinkler can shift from the inactive mode to a standby mode without being activated by heat from flue gases that are directed to the sprinkler. Typically, the structure of sprinklers is such that nozzles and other components are simultaneously protected against dirt, dust, deposits and other material that could disturb the sprinkler's qualities of reacting to fire or delivering extinguishing medium. The sprinkler can advantageously be used in surroundings where the only function of the cover is to protect the ampoule against dirt, dust and/or deposits, i.e. in surroundings where the sprinkler's quality of protecting the ampoule against heat is of no significance.

For the above purposes, the present invention provides a sprinkler comprising a holder body, at least one nozzle, a heat-activated release means and a cover which in a protective position is arranged in front of said nozzle when the sprinkler is in an inactive mode, the sprinkler comprising means for providing a displacement of the cover from the protective position to a free position in which the cover keeps clear of the nozzle so that it can spray extinguishing medium when the sprinkler is in an active mode, the holder body comprising an inlet for incoming extinguishing medium, wherein in the protective position the cover is arranged to protect the release means but, when displaced, is arranged to expose the release means and place the sprinkler in a standby mode in which the release means is intact so as to be able to react to heat and achieve a release of the sprinkler and place it in the active mode, and the means for achieving the displacement of the cover comprises a device which is displaceable with respect to the sprinkler and which is arranged under fluid pressure to exert a force on a locking means in the cover to make the locking means open and consequently displace the cover to said free position.

The displaceable device preferably comprises a projection area which is arranged to exert a force on the locking means under fluid pressure in a pressure chamber.

The displaceable device preferably comprises a sleeve-like part which together with the holder body defines the pressure chamber, the sleeve-like part comprising the projection area in the area of the pressure chamber. Such a structure is simple and operatively reliable.

The pressure chamber can be in fluid communication via a passage with the inlet when the sprinkler is in the inactive mode. This being the case, an extinguishing medium pressure in the inlet provides said force against the locking device. This provides an extremely simple way for the sprinkler to shift to the standby mode.

Alternatively, the pressure chamber is in fluid communication by means of a pipe, which can be called a control line, such that a fluid pressure in the pipe is arranged to provide said force against the locking device. This embodiment is particularly suitable when the aim is to achieve a sprinkler for a so-called wet pipe system with long pipelines, i.e. a system in which pressurized extinguishing medium is present in the pipelines and at the inlet of the sprinklers when they are in the inactive mode. The control line may have small dimensions and a low pressure compared with the dimensions of and the pressure in the pipelines.

When a sleeve-like part is used, it preferably comprises a cylindrical part which comprises a first cylindrical inner surface and a second cylindrical inner surface in the area of the pressure chamber, the first cylindrical inner surface having a larger diameter than the second cylindrical inner surface so that a shoulder forms between said cylindrical inner surfaces, the shoulder defining said projection area as a ring area. Such a cylindrical part is easy to make and easy to attach to the holder body. Furthermore, in this case the sleeve-like part is preferably sealed against the holder part by a first ring seal positioned in the first cylindrical inner surface and a second ring seal positioned in the second cylindrical inner surface in such a manner that the fluid supplied to the pressure chamber cannot flow out of the pressure chamber. This provides a simple way to hold the sprinkler tight against leakage when in the standby mode.

When a sleeve-like part is used, it is preferably composed of a third cylindrical inner surface arranged to rest tightly against a third ring seal when the sprinkler is displaced to the standby mode. This provides extra sealing against leakage; both the first and third ring seals seal against leakage.

The cover is preferably fluid-tight and hermetically arranged against the sprinkler by means of a seal which is preferably composed of the third ring seal. This provides the sprinkler with effective protection against dirt. The cover preferably comprises a cylindrical groove for the third ring seal, the groove being arranged to exert a compressive force on the ring seal when the cover is in said protective position, so that the ring seal holds the cover in place in said protective position.

The preferred embodiments of the invention are disclosed in the attached claims 2 to 16.

An important advantage of the sprinkler is that it can be heavily exposed to dirt and impurities, i.e. it may be used in applications in which sprinklers have not been considered to operate reliably, and have therefore never been installed. In such applications the sprinkler of the invention is able to operate, typically in response to signals from smoke detectors, without problems. Another important advantage is that it can be placed and used in surroundings in which the release of the sprinkler is to be avoided when it is exposed to heat, typically from hot flue gases, before it is first activated manually or by means of fire detectors in a manner not similar to that involving hot flue gases to place it in the standby mode in which it can then rapidly react to heat. This means that the sprinklers can be used to construct fire extinguishing systems by which extinguishing medium is likely to be discharged only at the site of the fire. The activation of the sprinklers and transition from the inactive to standby mode can be achieved very rapidly in different ways by means of fluid pressure (using different detection systems) without short exposition to heat producing such preactivation. This way no heat is directed to the sprinkler to cause it to shift to the standby mode. The fluid pressure can be produced by means of manual activation which for example starts pumps or opens valves for delivering fluid to the sprinkler, or by means of a fire detector (e.g. smoke, heat detectors which react to surface or radiating heat or optical flame detectors) which gives a signal for activating the fire extinguishing system/sprinkler. The signal can be given to a pump which starts to supply extinguishing medium to the sprinkler, or the detector can be arranged to give a signal to a valve which opens so as to supply fluid (extinguishing medium, for example) to the sprinkler. The structure of the sprinkler of the invention is also very simple; it can advantageously have a conventional glass ampoule as the heat-activated release means and the nozzles can be placed in the usual manner. The sensitive components of the sprinklers, such as the release means, are protected against mechanical impacts which could cause an unnecessary release of the sprinkler.

BRIEF DESCRIPTION OF THE DRAWINGS

In the following the invention will be described with reference to the attached drawing, in which.

DETAILED DESCRIPTION OF THE INVENTION

Figure 1:
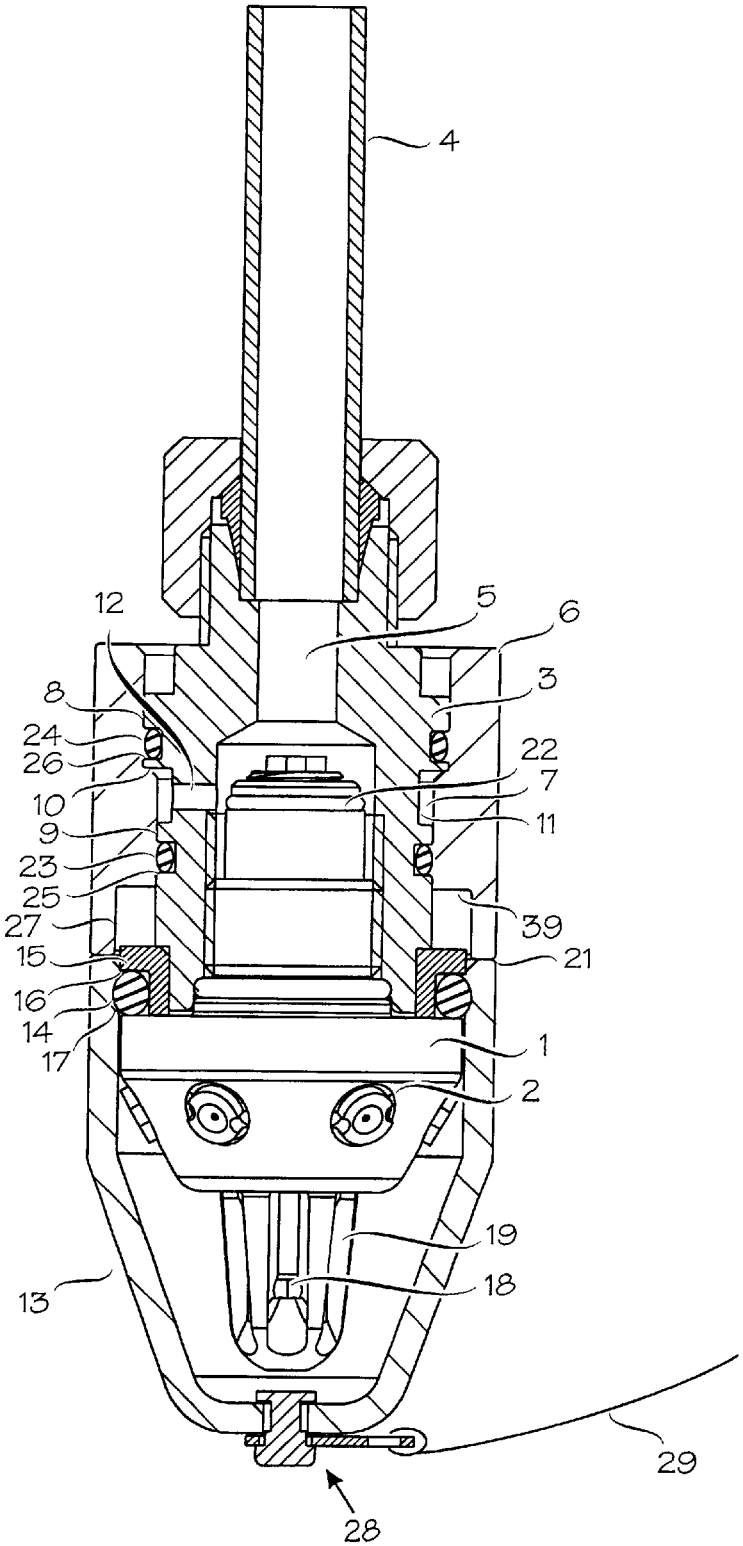
FIG. 1 shows the sprinkler of the invention in a first, inactive mode.

FIG. 1 shows the sprinkler of the invention in a first, inactive mode. The sprinkler comprises a nozzle frame 1 and a glass ampoule 18 attached to the nozzle frame by means of a holder 19. The nozzle frame 1, comprising a number of nozzles 2, is attached by means of a screw joint to a holder body 3, which, in turn, is attached to a pipeline 4 supplying extinguishing medium to an inlet 5 in the holder body 3 and further to the upper portion 22 of the nozzle frame.

The holder body 3 is enclosed in a cylindrical sleeve 6. The sleeve 6 is displaceable with respect to the holder body 3. A pressure chamber 7 is arranged between the sleeve 6 and the holder body 3. The pressure chamber 7 forms as the sleeve 6 has a second cylindrical inner surface 8 whose diameter is larger than a first cylindrical inner surface 9 of the sleeve. The passage between the cylindrical surfaces 8 and 9 define a shoulder 10. The pressure chamber 7 is also defined by a ring groove 11 provided in the holder body 3.

The pressure chamber 7 is in contact with the inlet 5 via a passage which is generally denoted by reference numeral 12.

The sleeve 6 is sealed against the holder body 3 by means of a first ring seal 23 at the first cylindrical inner surface 9 and a second ring seal 24 at the second cylindrical inner surface 8. The ring seals 23, 24 are attached to ring grooves 25 and 26, respectively, in the holder body 3. This provides a simple structure. The sleeve 6 has corresponding, but shallow, ring grooves for the ring seals 23, 24, the grooves being provided in the first cylindrical inner surface 9.

The sprinkler comprises a cup-shaped cover 13 which covers the glass ampoule 18 and the nozzles 2 and which is fixed by means of a ring seal 14 against a flange-like part 15 which, in turn, is fastened to the holder body 3. The flange-like part 15 forms a ring groove 16 for the ring seal 14. The cover 13 comprises a cylindrical groove 17 for receiving the ring seal 14. The ring seal 14 is suitably somewhat squeezed between the ring groove 16 and the cylindrical groove 17. The cylindrical groove 17 and the ring seal 14 can be said to provide a locking device which holds the cover in place in a protective position. Because of the ring seal 14, the cover 13 is not only steadily attached to the sprinkler, but also allows the important components of the sprinkler, such as the nozzles 2 and the glass ampoule 18, to be protected and hermetically sealed from the surroundings of the sprinkler. This is important since the sprinkler is intended to be used in various surroundings in which it is exposed to dirt which with time renders the sprinkler unusable or causes its operation to become unreliable without said cover 13.

In FIG. 1, the cover 13 is in a protective position in which it also acts as a heat cover which prevents the ampoule 18 from undesirable explosion in case of short hot gas flow towards the sprinkler, from a lorry's exhaust, for example, which would cause the sprinkler to lose extinguishing medium without any fire near to the sprinkler. In a fire, such a hot air flow can be created for instance when the sprinkler is mounted on a transport vehicle, such as an open rail car.

The sprinkler in FIG. 1 can be placed in the standby mode by pre-activation by supplying fluid under pressure from the pipeline 4 to the passage 12. This way a fluid pressure is created against the shoulder 10 in such a way that it creates a force which tends to push the sleeve 6 downwards. The magnitude of the force is determined by the product of the liquid pressure and the projecting ring surface that the shoulder 10 defines, seen in the longitudinal direction of the holder body (i.e. that of the pipeline 4). When the magnitude of the force exceeds the force needed to open the locking device created by the ring seal 14 and the groove 17, the cover 13 comes loose and is displaced by being pressed by the lower edge 21 of the sleeve in the position shown in FIG. 2.

Figure 2:
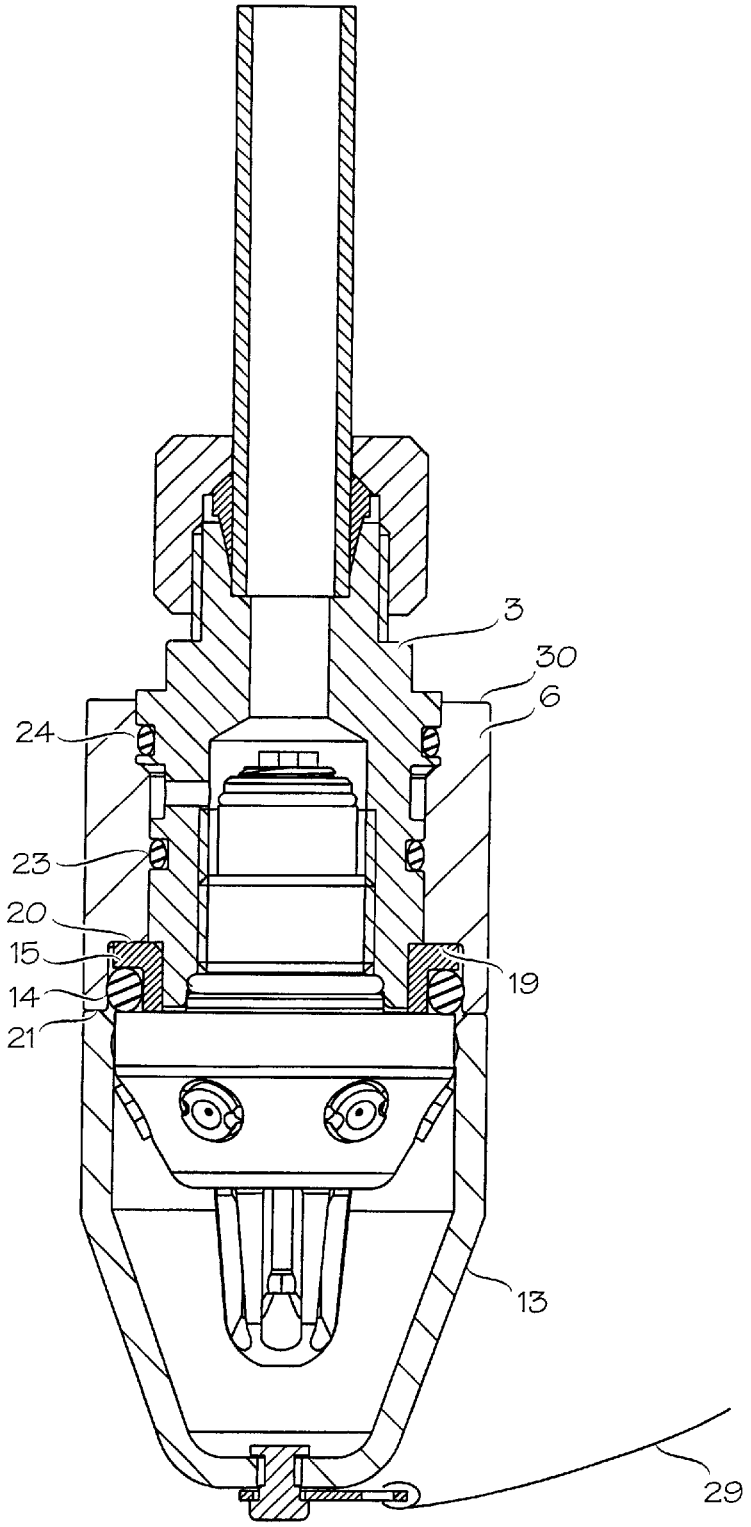
FIG. 2 shows the sprinkler of FIG. 1 in a mode immediately after activation.

FIGS. 2 and 1 shows that the sleeve 6 comprises a stop 39 which bears on the flange-like part 15. Consequently, the flange-like part can be called a blocking part 15.

Figure 3:
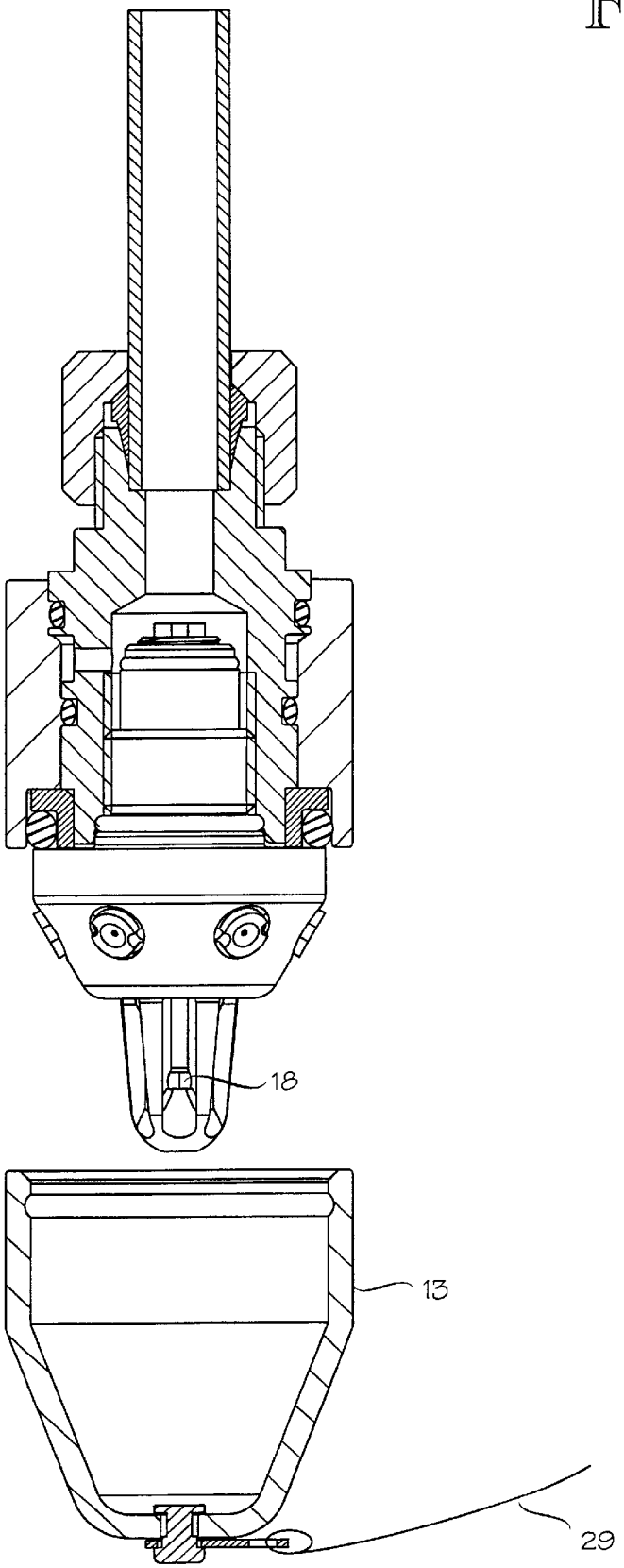
FIG. 3 shows the sprinkler of FIGS. 1 and 2 in the standby mode.

When the cover 13 is in the position shown in FIG. 2, it falls from the sprinkler, is released from the sleeve 6 and is placed in a released position, as is shown in FIG. 3. This way the sprinkler is placed in the standby mode.

The sleeve 6 comprises a third cylindrical inner surface 27 which is arranged to bear in a tightening manner on the ring seal 14 when the sprinkler is placed in the standby mode. FIG. 2 shows that the ring seal 14 gives additional security against leakage in case for some reason the ring seal 23 does not remain tight.

An upper portion 30 in the sleeve 6 is high enough for the ring seal 24 to bear fluid-tightly on the holder body 3.

When the sprinkler is in the standby mode shown in FIG. 3, the sprinkler can be released in the usual manner after the glass ampoule 18 has exploded by heat. When the ampoule explodes, the nozzles 2 are able to spray extinguishing medium.

Reference numeral 28 denotes a fastening part for receiving one end of a chain or corresponding elongated element 29 whose other end is fastened near the sprinkler, to a pipeline, for example. The element 29 prevents the cup 13 from dropping when the sprinkler shifts from the inactive to standby mode.

Figure 4:
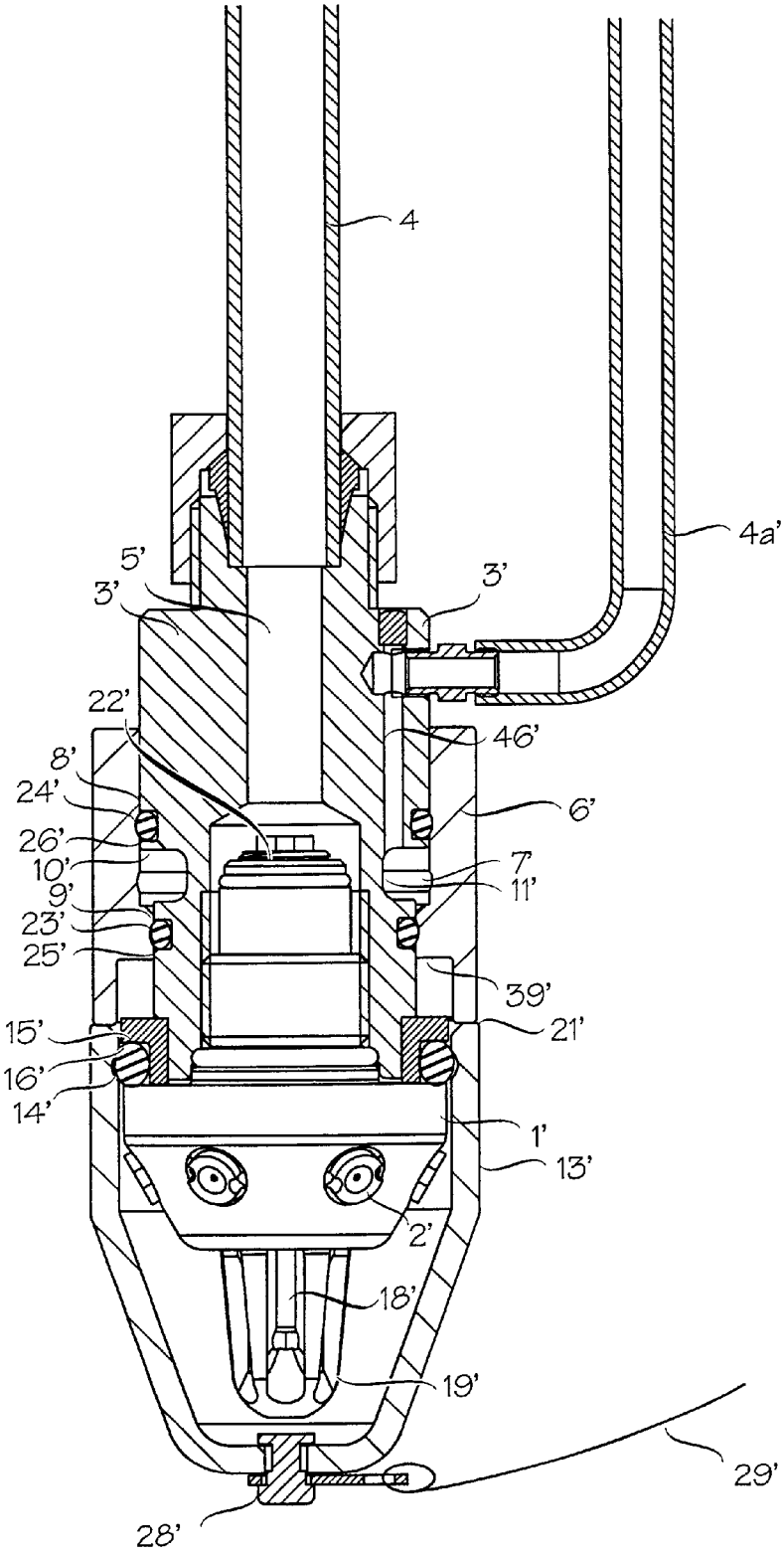
FIG. 4 shows another embodiment of the sprinkler of the invention.

FIG. 4 shows another embodiment of the sprinkler of the invention. The embodiment differs from that of FIG. 1 in that there is for instance no passage between the pressure chamber 7' and the inlet 5'. The sprinkler is activated to the standby mode, in which the cover 13' is displaced (as in FIG. 3), but the ampoule 18' is intact, by a pipe 4*a*' which by means of a duct 46' in the holder body 3' is in fluid communication with the pressure chamber 7'. By creating a fluid pressure in the pipe 4*a*', the cover 13' is displaced down as was described for the embodiment in FIG. 1. The fluid providing the displacement of the cover 13' does not have to be the same pressure medium as the extinguishing medium; the fluid may be a gas or a liquid not related to the extinguishing medium of the sprinkler. The fluid in the pipe 4*a*' is not in fluid communication with the inlet 5' when the sprinkler is in the inactive mode. Depending on the application, the pipe 4*a*' does not even have to be in fluid communication with the inlet 5' when the sprinkler is in the active mode.

Unlike the sprinkler in FIGS. 1 to 3, the sprinkler in FIG. 4 can have an extinguishing medium pressure in the inlet 5', applicable for example when the pipe 4 is a 'wet pipe', without the sprinkler being placed in the standby mode. This is important when long pipelines 4 are used; it takes time to fill long pipelines with extinguishing medium, and therefore pipelines of the type 'wet pipe' are preferable in said applications.

The invention has been described above only with reference to examples. It should be noted that the details of the invention may vary in many respects within the scope of the attached claims as compared with the examples. Instead of a sleeve-like part 6, the use of another type of displaceable device is feasible, for example a piston device which under fluid pressure is displaced and opens the locking device which holds the cover in place. The heat-activated ampoule does not necessarily have to be a glass ampoule, even though it is preferable in many cases. The heat-activated release device may instead be for example of a eutectic alloy or other material which melts at low temperatures, or a part which deforms in heat. The sprinkler may be a pressure compensated sprinkler, such as for example in WO 95/31252 or WO 96/08291, but it may also be more conventional, and thus non-pressure compensated.

What is claimed is:

1. A sprinkler comprising a holder body (3, 3'), at least one nozzle (2, 2'), a heat-activated release means (18, 18') and a cover (13, 13') which in a protective position is arranged in front of said nozzle when the sprinkler is in an inactive mode, the sprinkler comprising means (6, 10, 6', 10') for providing a displacement of the cover from the protective position to a free position in which the cover keeps clear of the nozzle so that it can spray extinguishing medium when the sprinkler is in an active mode, the holder body comprising an inlet (5, 5') for incoming extinguishing medium, wherein in the protective position the cover (13, 13') is arranged to protect the release means (18, 18') but, when displaced, is arranged to expose the release means and place the sprinkler in a standby mode in which the release means is intact so as to be able to react to heat and achieve a release of the sprinkler and place it in the active mode, and the means for achieving the displacement of the cover (13, 13') comprises a device (6, 6') which is displaceable with respect to the sprinkler and which is arranged under fluid pressure to exert a force on a locking means (14, 17, 14', 17') in the cover (13, 13') to make the locking means open and consequently displace the cover to said free position.

2. A sprinkler as claimed in claim 1, wherein the displaceable device (6, 6') is provided with a projection area which is arranged to exert a force on the locking means (14, 17, 14', 17') under fluid pressure in a pressure chamber (7, 7').

3. A sprinkler as claimed in claim 2, wherein the displaceable device comprises a sleeve-like part (6, 6') which together with the holder body (3, 3') defines the pressure chamber (7, 7'), the sleeve-like part (6, 6') comprising the projection area in the area of the pressure chamber (7, 7').

4. A sprinkler as claimed in claim 2 or 3, wherein the pressure chamber (7) is via a passage (12) in fluid communication with the inlet (5) when the sprinkler is in the inactive mode, an extinguishing medium pressure in the inlet being arranged to provide said force against the locking means (14, 17).

5. A sprinkler as claimed in claim 2 or 3, wherein the pressure chamber (7') is via a passage (46') in fluid communication with a pipe (4*a*), a fluid pressure in the pipe being arranged to provide said force against the locking means (14', 17').

6. A sprinkler as claimed in claim 5, wherein the pipe (4*a'*) is not in fluid communication with the inlet (5') when the sprinkler is in the inactive mode.

7. A sprinkler as claimed in claim 3, wherein the sleeve-like part (6, 6') comprises a first cylindrical inner surface (9, 9') and a second cylindrical inner surface (8, 8') in the area of the pressure chamber (7, 7'), the first cylindrical inner surface having a larger diameter than the second cylindrical inner surface such that a shoulder (10, 10') forms between said cylindrical inner surfaces, the shoulder defining said projection area as a ring area.

8. A sprinkler as claimed in claim 7, wherein the sleeve-like part (6, 6') is sealed against the holder body (3, 3') by a sealing means (23, 24, 23', 24') in such a manner that the fluid supplied to the pressure chamber (7, 7') cannot flow out of the pressure chamber past the sleeve-like part.

9. A sprinkler as claimed in claim 8, wherein said sealing means comprises a first ring seal (23, 23') positioned in the first cylindrical inner surface (9, 9') and a second ring seal (24, 24') positioned in the second cylindrical inner surface (8, 8').

10. A sprinkler as claimed in claim 9, wherein the first and second ring seals (23 and 24, 23' and 24', respectively) are positioned in corresponding ring grooves (25 and 26, 25' and 26', respectively) in the holder body (3, 3').

11. A sprinkler as claimed in claim 3, wherein the sleeve-like part (6, 6') comprises a stop (19, 19') arranged to come into contact with a blocking part (15, 15') which is stationary with respect to the holder body (3, 3') for restricting the displacement of the sleeve-like part with respect to the holder body.

12. A sprinkler as claimed in claim 1, wherein the cover (13, 13') is arranged fluid-tight against the sprinkler by means of a third seal (14,14').

13. A sprinkler as claimed in claim 12, wherein the third seal is composed of a ring seal (14, 14') for which the cover (13, 13') comprises a cylindrical groove (17, 17') by means of which groove and ring seal the cover is kept in place in the protective position.

14. A sprinkler as claimed in claim 13, wherein the sleeve-like part (6, 6') comprises a third cylindrical inner surface (27, 27') which is arranged by means of the ring seal (14, 14') to bear tightly on the sprinkler when the sprinkler is displaced to the standby mode.

15. A sprinkler as claimed in claim 1, wherein the cover is formed as a cup (13, 13') and comprises a fastening part (28, 28') for receiving a fastening end of a flexible elongated element (29, 29').

16. A sprinkler as claimed in claim 1, wherein the sprinkler comprises a nozzle frame (1, 1') which is detachably fastened to the holder body (3, 3').

* * * * *